United States Patent [19]

Scott

[11] 4,363,517

[45] Dec. 14, 1982

[54] PORTABLE BACK REST

[76] Inventor: Janet Scott, 18502 Haas Ave., Torrance, Calif. 90504

[21] Appl. No.: 251,355

[22] Filed: Apr. 6, 1981

[51] Int. Cl.[3] ..... A47C 1/024; A47C 1/14

[52] U.S. Cl. ..... 297/377; 5/433

[58] Field of Search ..... 297/377, 391, 354, 355; 248/118; 5/431–433

[56] References Cited

U.S. PATENT DOCUMENTS

| | | | |
|---|---|---|---|
| 486,275 | 11/1892 | Butler | 297/377 |
| 1,659,093 | 2/1928 | Gaskin | 297/377 |
| 3,822,424 | 7/1974 | Messer | 297/377 X |

FOREIGN PATENT DOCUMENTS

| | | | |
|---|---|---|---|
| 583583 | 1/1925 | France | 297/377 |
| 962694 | 7/1964 | United Kingdom | 5/432 |

*Primary Examiner*—William E. Lyddane

[57] ABSTRACT

An elongate head and back support with front and rear ends engageable with and between the top of a body supporting the head or back of a person resting on a flat surface; the support includes an elongate upwardly and rearwardly inclined rectangular panel with a forwardly disposed head and back engaging front and a releasable coupling part substantially central of its rear; an elongate T-shaped strut with an elongate inclined post with an upper forward end releasably engaged with said coupling part and a lower rear end adjacent said surface and an elongate transversely extending foot with an upper central portion joined with said rear end, a transversely extending lower edge spaced below said rear end, the lower portion of the foot occurs below the rear end of the post to penetrate and establish anchored engagement in the supporting surface.

4 Claims, 19 Drawing Figures

PORTABLE BACK REST

This invention has to do with a novel, portable and convertible head and back support.

BACKGROUND OF THE INVENTION

It has long been the common practice of persons recreating at parks and beaches to equip themselves with pillows, folding portable back rests and the like to provide comfortable support for their heads, while lying on sand or turf or any other flat surface and/or to comfortably support their backs when sitting on the sand or turf.

Conventional pillows such as might be used for the above purpose are generally large and bulky items which are extremely inconvenient, if not difficult to carry about when one walks or otherwise travels to and from a recreation site. Further, while such pillows afford comfortable support for one's head, while lying on a flat surface with his or her head in a substantially horizontal, face-up position, they are substantially ineffective to hold and comfortably support the head up at an angle where the person's face is disposed so that he or she can visually pan horizontally and observe ongoing activities in the surrounding area which is a most common position assumed by persons recreating at parks and beaches. Such positioning of one's head is most commonly attained by piled up sand or gathered together and piled up articles of clothing and the like to establish an adequate head support.

Those portable folding backrests provided by the prior art for use by those recreating at parks and beaches are rather large and complicated structures most commonly comprising three pivotally related substantially rectangular frames of wood or metal tubing; there being a horizontal base frame and upwardly and rearwardly inclined back supporting frame and a forwardly and upwardly inclined bracing frame. The several frames are shiftable from a flat folded down condition to an up or open position where the base frame rests upon the sand or turf, the support frame is inclined upwardly and rearwardly above the base frame and the bracing frame extends upwardly and forwardly from the base frame to engage the support frame. The support frame carries a panel of fabric or the like to engage and support the back of one sitting on the sand or turf immediately forward the support structure.

Ordinary folding portable backrests of the character referred to above are so large and inconvenient to use that most people consider them to be a nuisance. Further, they are oftentimes extremely uncomfortable since one or more of the sides and/or rails of the frame structure (more often than not) engage and bear against a part of the user's body, to interfere with his or her circulation or otherwise cause discomfort.

The above noted shortcomings and/or disadvantages associated with ordinary pillows and common folding backrests are but a few of the more apparent and most commonly recognized shortcomings that might be listed and which point to the reasons the portage and use of such equipment by the overwhelming majority of parks and beach goers is avoided.

OBJECTS AND FEATURES OF MY INVENTION

It is an object of my invention to provide a novel support structure which is particularly suitable to comfortably support the back of a person seated on sand or turf and to comfortably support the person's head at an angle for convenient horizontal visual monitoring of ongoing activities on a sandy beach or turf, when the person is lying with his or her back on the sand or turf.

It is another object and feature of my invention to provide a support structure of the character referred to above which includes two small lightweight, easy and economical-to-make parts and a structure which is extremely easy and convenient to use.

Another object and feature of my invention is to provide a support structure of the general character referred to above wherein one part includes an elongate horizontal transversely extending sand or turf engaging foot and an elongate column or post projecting forwardly and upwardly from the foot and wherein the other part is a flat upwardly and rearwardly inclined substantially rectangular panel with a flat forwardly and upwardly disposed supporting surface and which includes means releasably engaging the upper forward end of the said post.

It is an object of this invention to provide a support structure of the general character referred to in the foregoing wherein the means releasably engaging the post selectively couples the panel to the post with the plane of the upwardly and rearwardly inclined panel at one or the other of two predetermined angles relative to the other axis of the post.

The foregoing and other objects and features of my invention will be fully understood from the following detailed description of one typical preferred form and carrying out of my invention, throughout which description reference is made to the accompanying drawings.

DESCRIPTION OF THE DRAWINGS

FIG. 17 is an enlarged detailed sectional view of the panel and pad assembly.

DETAILED DESCRIPTION OF THE INVENTION

Figure 1:
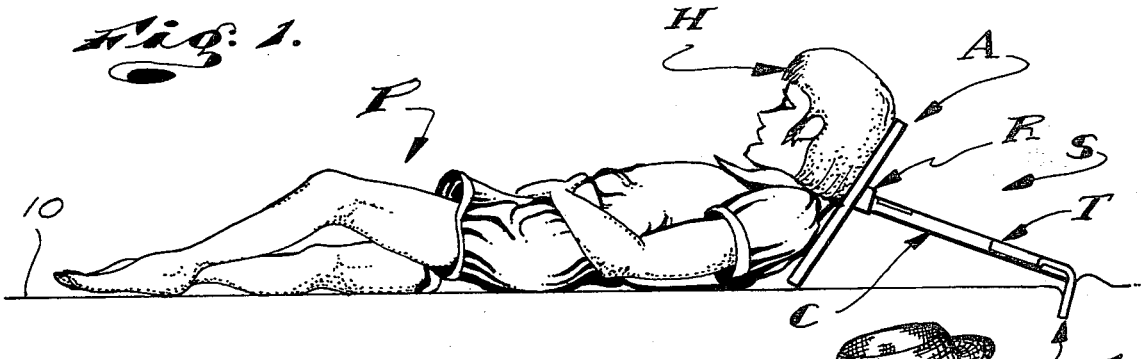
FIG. 1 is a view showing my support structure in one position and supporting a user's head.
Figure 2:
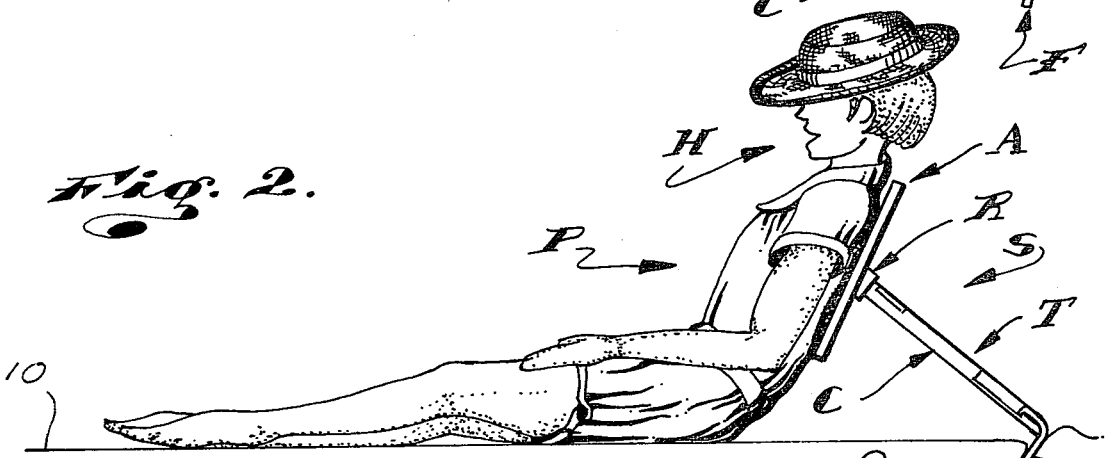
FIG. 2 is a view showing my support in another position and supporting a user's back.

In FIGS. 1 and 2 of the drawings, I have shown my new support structure S in use in those two positions for which it is intended to be used. In FIG. 1 of the drawings, a person P using the support structure S is shown lying, back-down, on the substantially flat horizontal surface 10 of a sand beach or other similar plane. The person's head H is held or supported by the support structure S in that upwardly inclined position where his or her face is disposed sufficiently close to horizontal so that the person can visually monitor ongoing activities on or about the beach. In FIG. 2 of the drawings, the person P is shown sitting on the surface 10 of the beach with his or her back inclined upwardly and rearwardly at a restful angle and engaged and supported by a support structure S.

The two positions of the person P shown in FIGS. 1 and 2 of the drawings are those two positions which are most commonly sought to be attained with various types and forms of support means by persons recreating at beaches, on turfs and the like.

By extensive testing, I determined that when a person is at rest in that position shown in FIG. 1 of the drawings, the angle of the supporting surface engaging the back of his or her head must be at 35° from vertical, plus or minus three or four degrees. If the angle of the head support is 32° or less from vertical, the person's chin is, most often, discomfortingly urged down and into engagement with his or her collarbone and his or her neck is discomfortingly bent. If the angle is 38° or more from vertical, the person's face is disposed upwardly at such an angle that horizontal visual monitoring of the surroundings is so difficult and/or inconvenient that attempting to watch ongoing activities is dispensed with.

In accordance with the above, when one is reclining in the position shown in FIG. 1 of the drawings, the mean or average effective angle, from vertical, at which is or her head must be disposed, and the corresponding means or average angle of a suitable support for his or her head has been determined to be 35°. It has been further determined that if that angle is in increased or decreased 3°, adverse and discomforting effects are likely to be encountered.

In addition to the foregoing, testing has determined that when a person is at rest in that position shown in FIG. 2 of the drawings, the angle of his or her back and of the supporting surface engaging his or her back must be at 25% from vertical, plus or minus 5°, if stable and comfortable reclining is to be sustained.

If the angle of one's back is supported at more than 30° from vertical, there is a tendancy for his or her body to shift and slide forwardly and downwardly relative to the support and/or must bend his or her shoulders and neck forward to an unnatural and fatiguing extent to attain proper balance of his or her head. If the angle of one's back is supported at an angle less than 20° from vertical, the need for a back support becomes unnecessary and the attaining of a free upright sitting position is favored.

In accordance with the foregoing, when one is sitting in the position shown in FIG. 2 of the drawings, the mean or average effective angle, from vertical, at which his or her back must be disposed and/or the resulting mean angle of a supporting surface for his or her back has been determined to be 25°. It has been further determined that in the case of most people, if the above noted angle is increased or decreased 5°, adverse effects are likely to be experienced.

It will be noted and must be kept in mind that the mean or average 35° support angle for one's head, when reclining in that position shown in FIG. 1 of the drawings is notably different from the mean 25° support angle for one's back, when sitting in that position shown in FIG. 2 of the drawings. Furthermore, a support structure having a supporting surface effectively disposed to support one's head, as shown in FIG. 1 of the drawings, would be ineffective to engage and support the back of a person sitting in that position shown in FIG. 2 of the drawings and vice-versa.

By tests conducted, it has been determined that a support structure for engaging one's back, when sitting in that position shown in FIG. 2 of the drawings, is preferably narrow and such that it engages the central portion of one's back between and preferably clear or out of interfering engagement with the person's shoulderblades or scapula. In accordance with the foregoing, it has been determined that when such a support structure is so wide as to engage one's scapula, the forces and/or pressures encountered are discomfortingly concentrated on the scapula. A back support engaging one's scapula tends to adversely interfere with free mobility of one's arms and shoulders. Still further, in such a case, when one moves his or her arms and shoulders, the attending movement of the scapula tends to move or displace the support and to shift or redistribute countering forces in such a manner that the support tends to shift out of set position and is rendered unstable. Accordingly, in order to provide comfortable, stable and non-restrictive support for the back of one sitting in the position shown in FIG. 2 of the drawings, it is highly desirable that the support be sufficiently narrow to engage the back of the user between and clear from his or her scapula.

In accordance with the above, it has been determined that the part or portion of a support engaging a person's back be no more than about four (4) inches wide so that it can effectively engage and support the upper central portion of one's back clear and out of interfering engagement with one's scapula. With such a relationship of one's back and a related support, the support afforded is stable, non-fatiguing and such that it does not interfere with and is not adversely affected by the free movement of one's arm and/or shoulders.

The foregoing is equally applicable to a support structure provided to support one's head when one is in that reclining position shown in FIG. 1 of the drawings. That is, the head engaging portion of the support should be such that it does not normally extend across one's back on such a manner as to engage one's scapula, to interfere with free movement of one's arms and shoulders or distribute forces in a fatiguing and discomforting manner.

In practice, when one is reclining and his or her head is supported up in the manner shown in FIG. 1 of the drawings, it is important that the support afforded for the head extended down and forward from the head to engage and support that portion of the person's spine immediately below the neck, to turn that portion of the spline and the person's shoulders up to a non-stressful extent and to thereby reduce the extent to which the neck must be bent. That is, to attain comfortable and effective support of one's head in the position shown in FIG. 1 of the drawings, it is most desirable that flexure of the neck alone not be relied upon and that flexure of the neck be supplemented by limited upward flexure of the upper portion of the person's spine with attending limited elevation of one's shoulders.

In accordance with the above, it has been determined that the head engaging part of a support structure, to support one's head in the position shown in FIG. 1 of the drawings, should extend down and forward and not only support the head, but also support the upper end portion of the spline. As a result of the above, the head and back engaging portion of such a support structure is preferably sufficiently long to extend between and establish desired supporting engagement with the user's head and upper end portion of the user's back or spine. In practice, a support part about 11 inches long and extending upwardly and rearwardly from the supporting surface 10 has been found to be effective and satisfactory to afford desired support for the overwhelming majority of people.

In furtherance of the above, the forces exerted by the user's head and the user's upper back on the support part engaging the user's head and back are most commonly resolved rearwardly and downwardly at angles from 15° to 25° from horizontal and therefore tend to shift the support structure horizontally rearwardly and out of desired supporting position and engagement with the user's head and back. In accordance with the above, an effective support structure must include means for supporting the head and back supporting part in desired angular disposition and which also engages the surface 10 of the sand or turf in such a manner that it prevents horizontal rearward displacement of the support structure relative to that surface and to the user of the structure.

Referring once again to FIG. 2 of the drawings, the forces exerted onto the upwardly and rearwardly inclined back engaging part by the user's body are most commonly resolved rearwardly and downwardly at angles from 35° to 45° from horizontal. Accordingly, an effective support structure for one's back must include means for supporting the back supporting part in desired elevated and angular disposition and must engage the surface 10 of the sand or turf in a manner to effectively and efficiently counteract the downwardly and rearwardly resolved forces and prevent undesired shifting and/or displacement of the support structure when in use.

Testing of various means for supporting the head and/or back engaging parts of support structures of the general character here concerned with has established that an elongated, flat transversely extending substantially vertical sand or turf engaging blade or plate-like foot having a straight lower horizontal sand or turf engaging edge and defining a flat rearwardly and downwardly disposed sand or turf engaging surface of substantial cross-sectional area is the most universally effective form of stop means to engage sand and turf-like surfaces and afford desired support for head and/or back supporting parts of such support structures. The lower edges of such stop means allow for easy and effective entry of such stop means into engagement in the sand or turf and the flat downwardly and rearwardly disposed surfaces thereof must effectively distribute the loads and forces directed through the support structures into the sand or turf.

While other special forms and/or types of sand or turf engaging support structures might be designed to afford superior engagement with particular forms of turf and/or particulate material, the above noted simple blade-like foot is believed to be most universally effective.

In furtherance of the foregoing, the support structure S that I provide and which is illustrated in detail throughout the drawings includes a flat, rectangular rearwardly and upwardly inclined support panel A with forwardly and upwardly disposed and rearwardly and downwardly disposed front and rear surfaces 11 and 12, straight horizontal laterally extending opposite ends 14 and 15 and straight parallel longitudinally extending sides 16.

The panel A further includes or is provided with a coupling part in the form of a socket-like receptacle R, formed integrally with the panel and arranged substantially centrally thereof. The receptacle R projects substantially rearwardly from the rear surface 12 of the panel. The receptacle R defines an elongate polygonal substantially rearwardly opening socket 17, the axis of which is inclined at an angle of approximately 15° from normal relative to the plane of the panel and toward the end 14 thereof.

Figure 3:
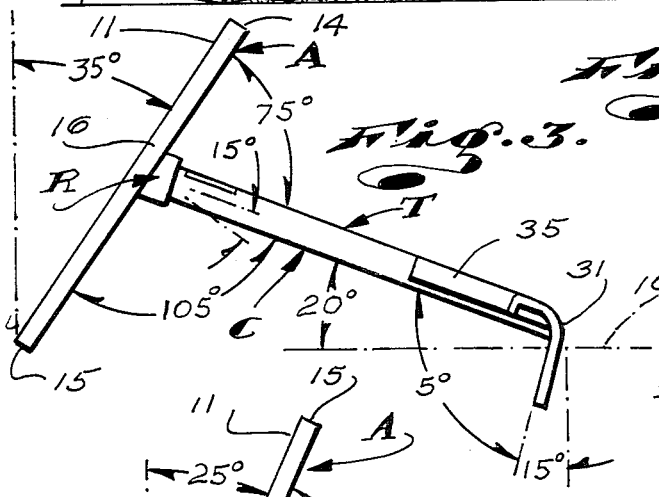
FIG. 3 is a side view of my support in one position.
Figure 4:
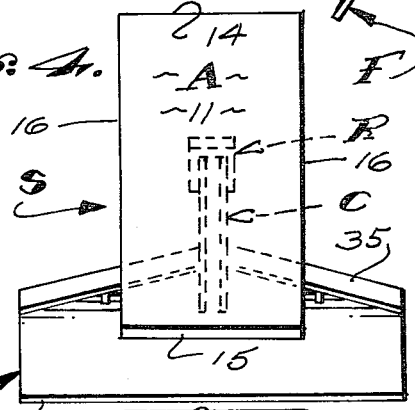
FIG. 4 is a front view of the structure shown in FIG. 3.
Figure 5:
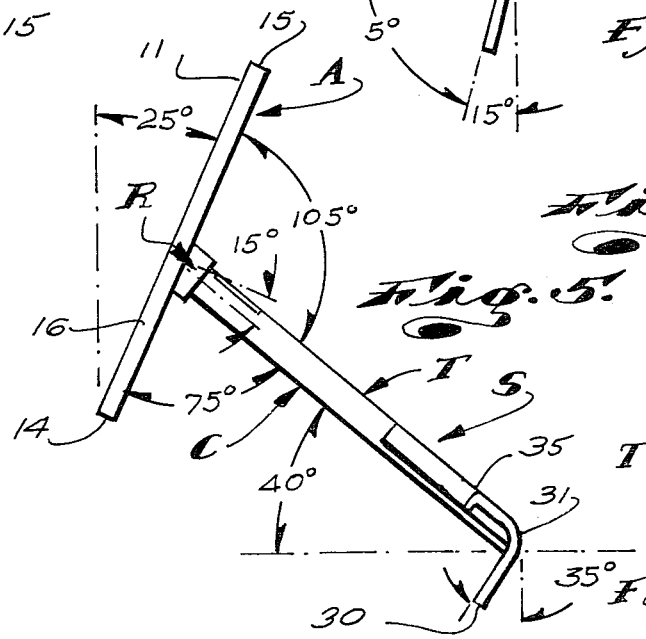
FIG. 5 is a view similar to FIG. 3 showing the structure in another position.

With the above relationship of parts, when the panel A is arranged with its plane at an angle of 35° from normal, with its end 14 at the top, the axis of the socket opening 17 is at an angle of 20° from horizontal, and when the panel is arranged with its plane at an angle of 25° from normal, with its 14 at the top, the axis of the socket is at an angle of 40° from horizontal, as clearly shown and indicated in FIGS. 3 and 5 of the drawings.

In practice, and to attain a better balance of parts when the construction is in use, the receptacle R is preferably arranged centrally between the sides 16 and is offset longitudinally from the center of the panel A, toward the end 14 thereof, a short or limited distance.

The socket 17 is preferably rectangular in cross-section, measuring, for example, 1 inch by 1-1/16 inches. The socket is arranged with its major dimension parallel with and with its minor dimension normal to the longitudinal axis of the panel.

Figure 8:
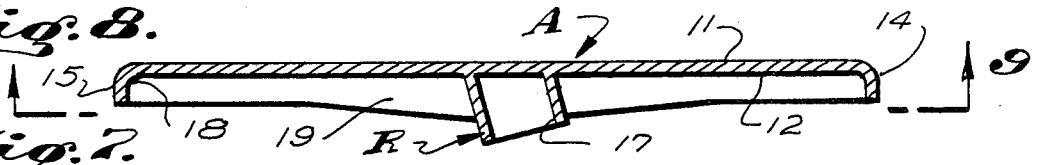
FIG. 8 is a view taken as indicated by line 8—8 on FIG. 7.
Figure 7:
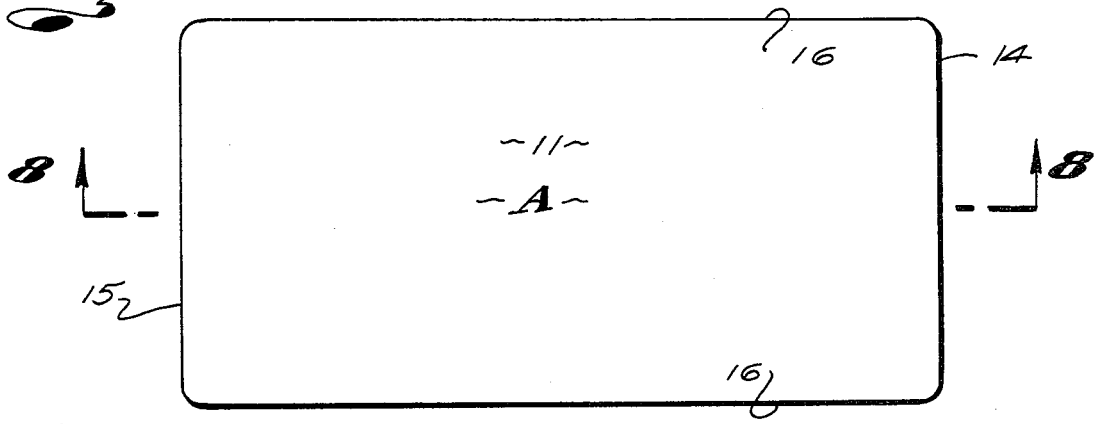
FIG. 7 is a front view of the panel that I provide.
Figure 9:
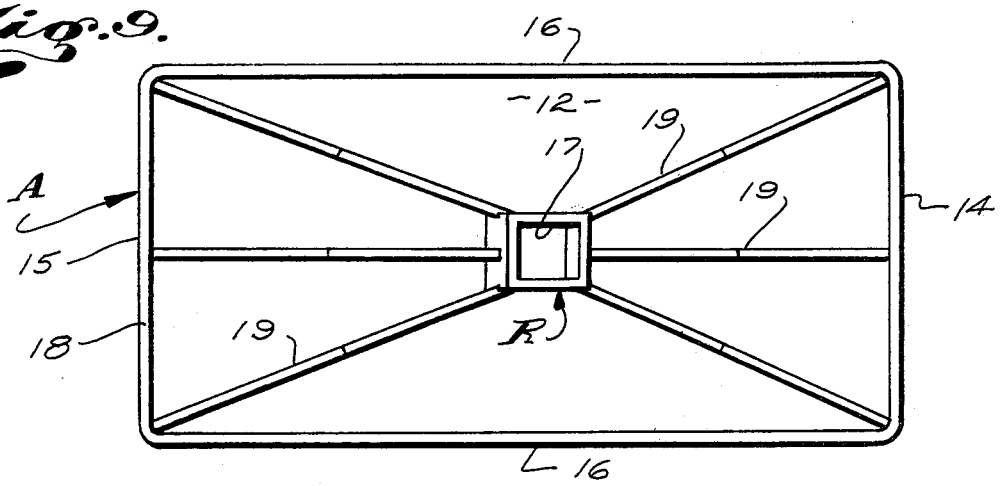
FIG. 9 is a view taken as indicated by line 9—9 on FIG. 8.
Figure 13:
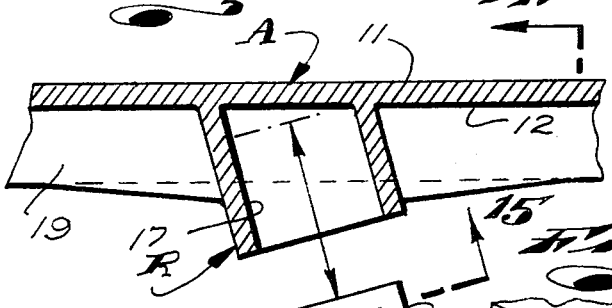
FIG. 13 is an exploded view of portions of my invention.
Figure 14:
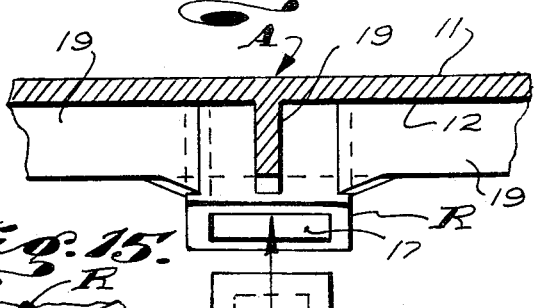
FIG. 14 is a view taken as indicated by line 14—14 on FIG. 13.
Figure 15:
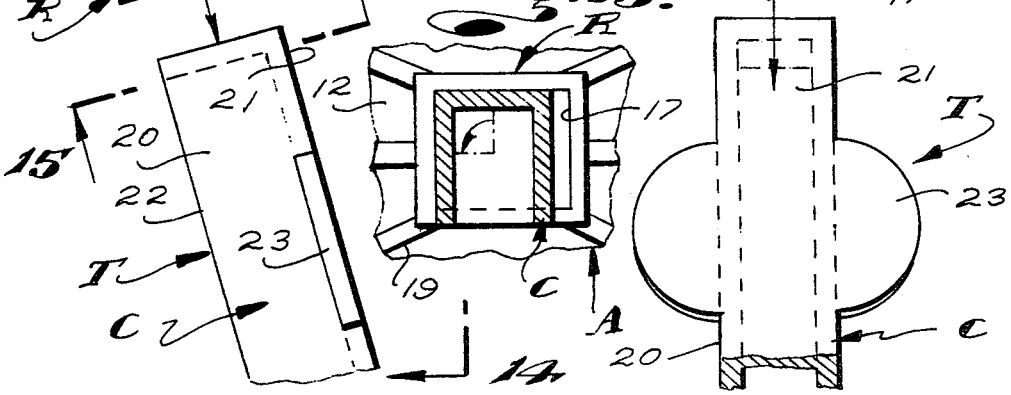
FIG. 15 is a view taken as indicated by line 15—15 on FIG. 13.

In practice, and as best shown in FIGS. 7, 8 and 9 of the drawings, the panel is a lightweight unitary part molded of plastic or the like and is provided with suitable flanges 18 and webs 19 about its perimeter and across its rear surface 12 to suitably stiffen and reinforce the structure and to establish suitable radiused corners and edges, where desired.

The support structure S that I provide next includes an elongate, unitary substantially T-shaped strut T, including an elongate longitudinally extending column or post C and an elongate laterally extending foot F.

The post C is a straight elongate part normally inclined forwardly and upwardly and has a free upper forward end and a lower rear end which is integrally joined with the foot F. The post C is polygonal or rectangular in cross-section, corresponding in outside dimensions with the inside dimensions of the socket 17 of the receptacle R on the panel A.

The upper forward end portion of the post C is normally slidably engaged in the socket 17 of the receptacle R and in stopped engagement with the bottom thereof. The post is engageable in said socket in two rotative positions, 180° apart.

The post C has straight, parallel vertical side surfaces 20 and straight, parallel, forwardly and upwardly inclined top and bottom surfaces 21 and 22.

In practice, and as shown in the drawings, the free end portion of the post C (which measures about 1 inch by 1-1/6 inches in cross-section) is formed with a pair of laterally outwardly projecting semicircular flange-like enlargements 22 spaced rearwardly from the free end of the post. The enlargements 22 were required to prevent excessive entry of the free end of the post into a child's mouth and to prevent accidental and dangerous penetration of that end of the post into one's flesh.

The foot F of the strut T is a substantially flat, straight elongate laterally extending vertical blade-like plate with a straight horizontal lower edge 30, an upper edge portion 31 which is shown turned forwardly, a flat, substantially forwardly disposed front surface 32 and a flat substantially rearwardly disposed rear surface 33.

The flat plate or blade-like foot F is formed integrally with the post C with its plane disposed downwardly and rearwardly at an angle of about 5° relative to the longitudinal axis of the post, as shown and indicated in FIGS. 3 and 5 of the drawings.

Figure 10:
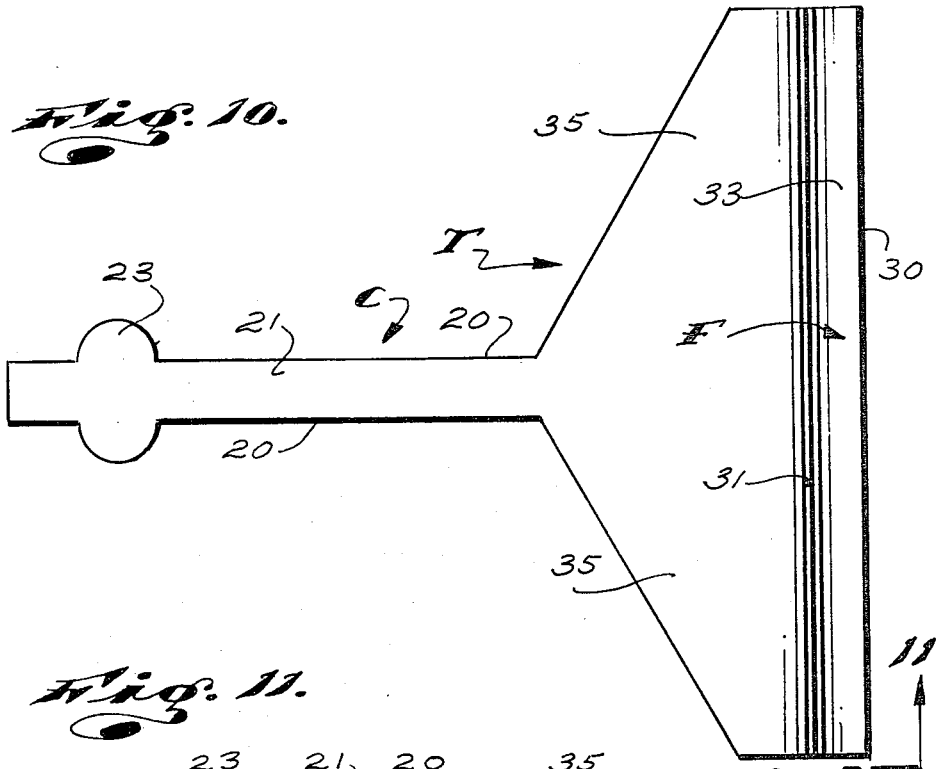
FIG. 10 is a top view of a part of my invention.
Figure 11:
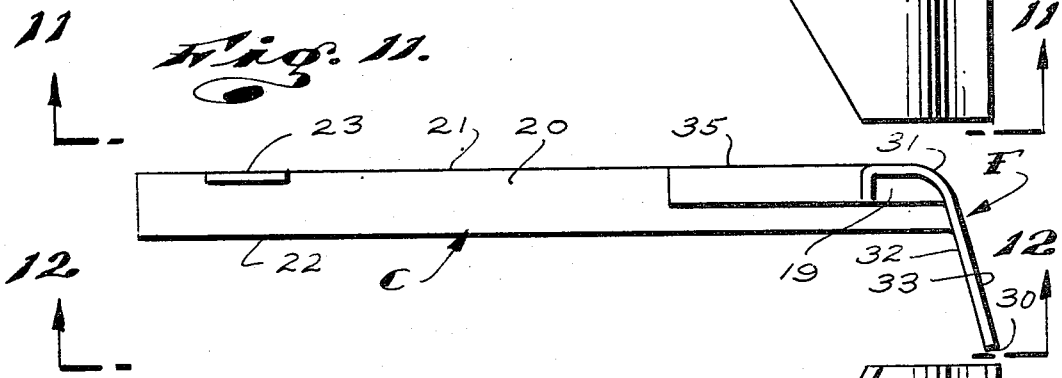
FIG. 11 is a view taken as indicated by line 11—11 on FIG. 10.
Figure 12:
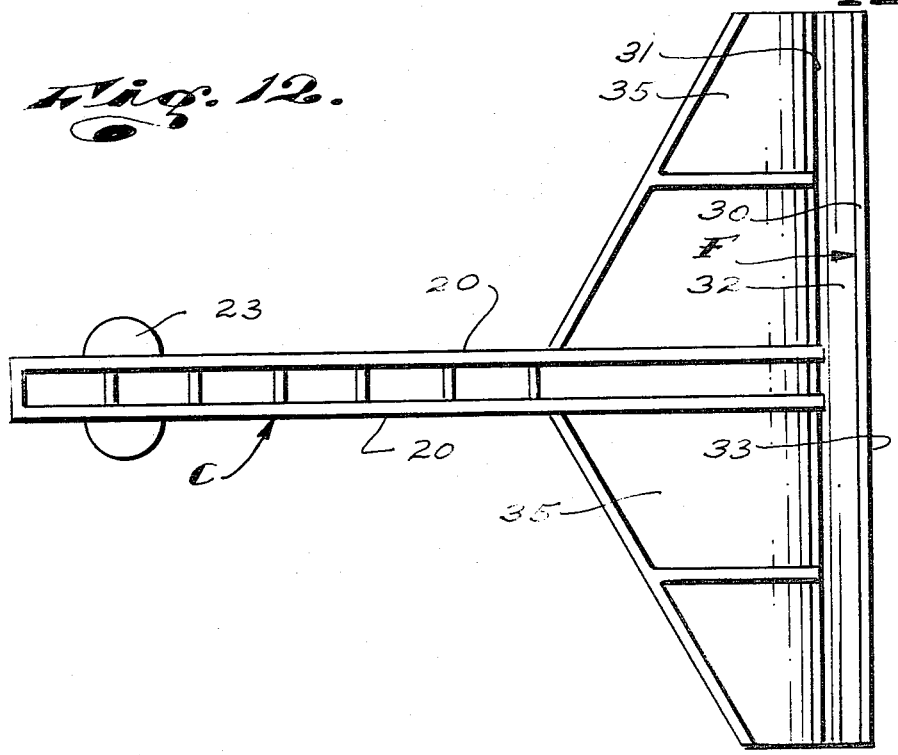
FIG. 12 is a view taken as indicated by line 12—12 on FIG. 11.
Figure 16:
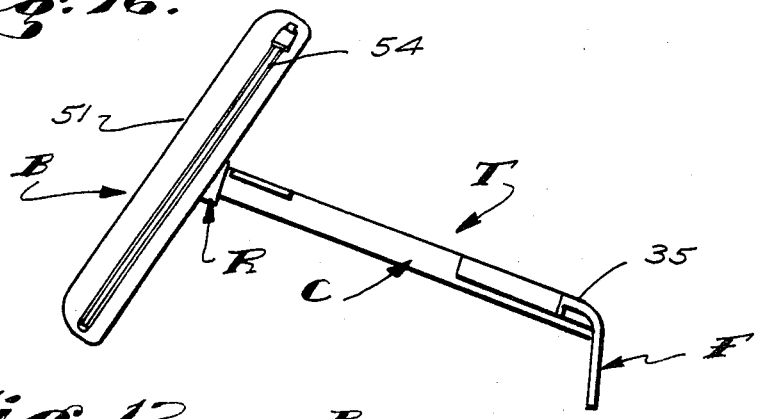
FIG. 16 is a view similar to FIG. 3 with a pad related to it.
Figure 12:
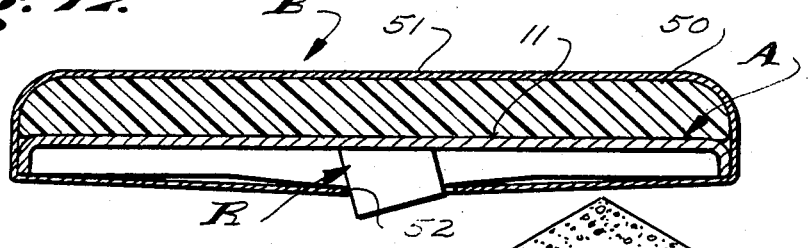
Figure 18:
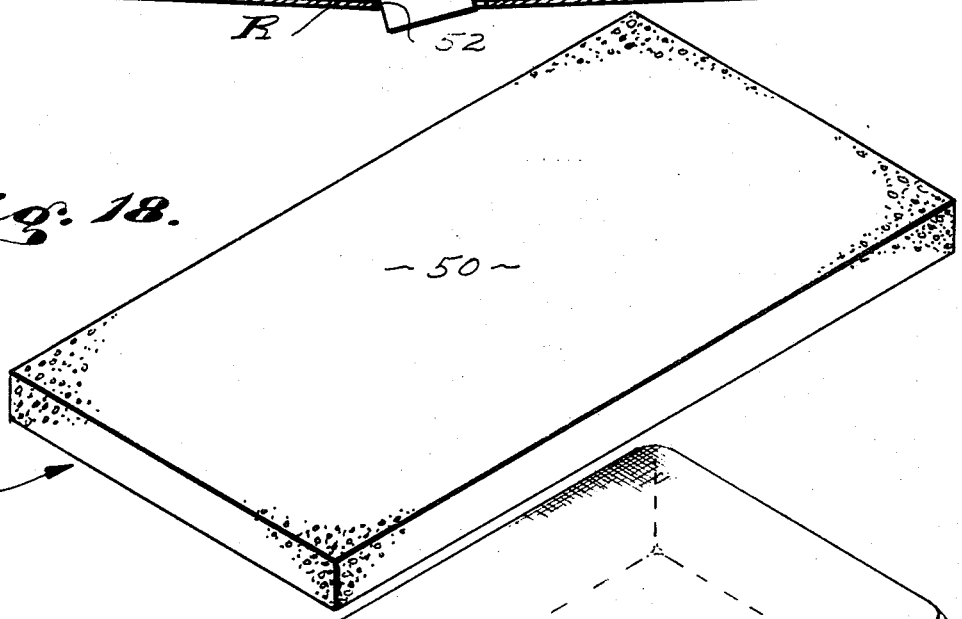
FIGS. 18 and 19 are isometric views of parts of the pad structure.
Figure 19:
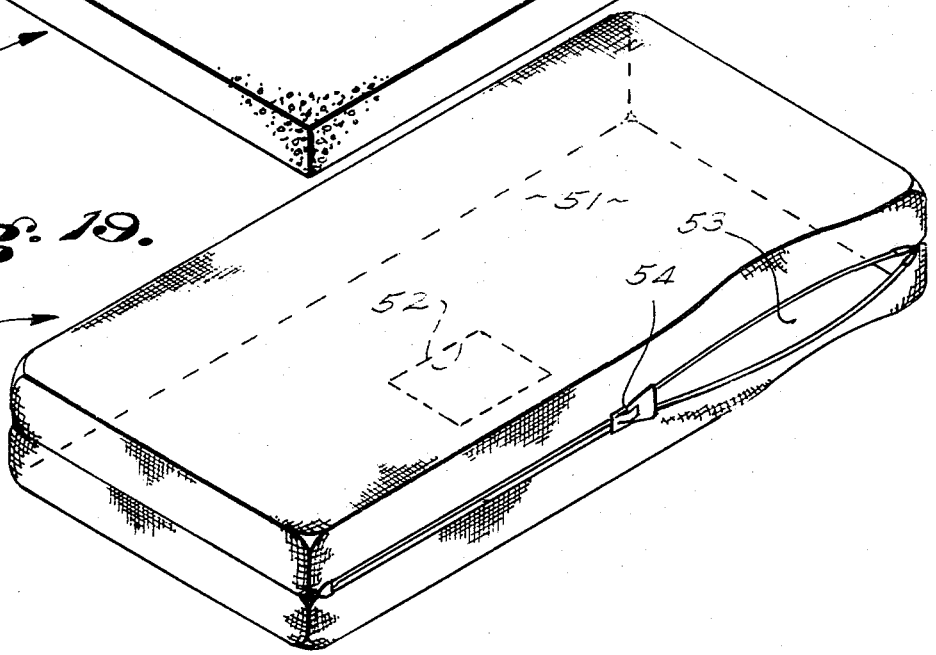

The lower rear end of the post joins the forward surface 32 of the foot F midway between the opposite ends of the foot and adjacent the upper edge portion thereof, as clearly shown in FIGS. 10, 11 and 12 of the drawings. With such a relationship of parts, the major portion of the foot projects down from and occurs below the rear end of the post and is free to engage and enter into a bed of sand or turf without interference by the post.

Finally, and in practice, the strut T, like the panel A, is a unitary part molded of plastic or the like and is formed with flat reinforcing gusset plates 35 extending from the rear end portions of the post, at opposite sides thereof to the upper edge portion 31 of the foot F, as clearly shown in the drawings. The gusset plates 35 suitably reinforce the foot F and prevent undesired deflection and working of the opposite end portions of the foot when the structure is in use.

In practice, the strut T is provided with suitable reinforcing flanges, webs and the like, as clearly shown in FIGS. 10, 11 and 12 of the drawings.

In FIGS . 1, 3 and 4 of the drawings, the panel A is in a first position relative to the strut T. When in said first position, the lower or downwardly disposed end 15 of the panel A rests upon the top surface 10 of the sand or turf and the foot F of the strut is engaged in the sand or turf, whereby the panel and strut are in the nature of a self-supporting A-frame and the foot F functions as a "dead-man" to anchor and to prevent longitudinal and particularly rearward shifting or displacement of the structure. The panel A is rearwardly and upwardly inclined at an angle of about 35° from vertical and its flat front surface 11 is forwardly and upwardly disposed to effectively engage and support the upper center of a user's back and the rear of the user's head, when the user is lying, back-down, upon the surface 10 immediately forward of the support structure.

Figure 6:
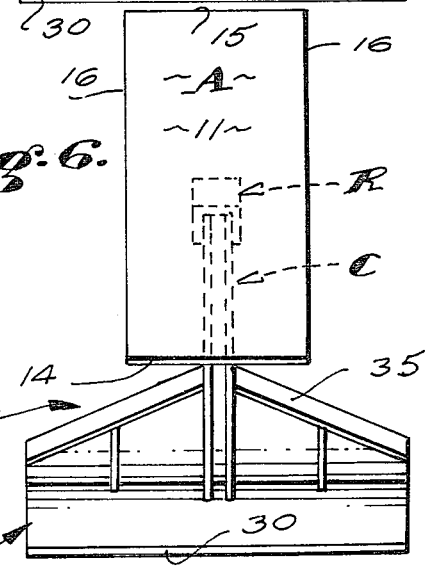
FIG. 6 is a front view of the structure shown in FIG. 5.

In FIGS. 2, 5 and 6 of the drawings, the panel A is in its second or other rotative position relative to the post C of the strut T. When in the position noted, the foot F of the strut T is engaged within the surf or sand and the panel and the front end of the post are elevated so that the front surface 11 of the panel is inclined rearwardly and upwardly at about 25°, plus or minus 5°, from vertical and to that position where the panel occurs and establishes supporting engagement with the upper central portion of the back of a user, seated on the sand or turf immediately forward of the support structure, as shown in FIG. 2 of the drawings.

When in use, as noted above, and as shown in FIG. 2 of the drawings, the panel A, engaging the upper portion of the user's back, occurs between the user's scapula so as not to interfere with free movement of the user's arms and shoulders and is held steady against extensive lateral shifting and/or displacement by the elongate foot F of the construction, which foot extends laterally of the longitudinally axis of the construction and is set in secure anchored engagement in and with the turf or sand.

In practice, the foot F is about 10 inches in lateral extent and about 2 inches in vertical extent. The post is about 13 inches long and about 1 inch by 1-1/16 inches in cross-section and the panel A measures about 11 inches by 7 inches in plane configuration.

In furtherance of my invention, and as shown in FIGS. 16 through 19 of the drawings, I provide the panel with a soft resilient pad B. The pad B includes a sheet-like core or pad 50 of soft resilient foam plastic corresponding with or slightly greater in plan configuration than the panel A overlying the front surface 11 thereof. The pad 50 is covered and is retained adjacent with the panel A by a sewn fabric envelope or cover 51 engaged about the assembled panel and pad. The envelope 51 has a window 52 in a rear wall to accommodate the receptacle R and has an opening 53 along one side to facilitate assembly and disassembly of the panel, pad and envelope. The side opening is provided with a zipper 54 to close the envelope and secure the assemblage.

The above noted pad B is an important part of the overall support structure since it conforms to irregularities in the user's back and/or head to provide a more comfortable, uniform and secure interengagement between the panel and the portions of the user's body related thereto. Of equal importance, the pad compensates for misalignment that is likely to occur between the user's body and the support structure and which would, but for the pad, bring about adverse effects.

When the support structure that I provide is not in use, the strut post C can be removed from engagement in the receptacle socket 17 and the two flat elongate parts, that is, the panel A and strut T can be arranged in flat engagement, one adjacent the other, and can be conveniently held and carried in one's hand or can be placed in a beach bag or other suitable container or receptacle for convenient portage.

From the foregoing, it will be apparent that I have invented a novel, neat and attractive, compact and lightweight dual purpose support structure which is inexpensive to manufacture, easy and convenient to use and which is highly effective and dependable in use.

Having described only one typical preferred embodiment of my invention, I do not wish to be limited to the specific details herein set forth, but wish to reserve to myself any modifications and/or variations that may appear to those skilled in the art to which the invention pertains and which fall within the scope of the following claims.

Having described my invention, I claim:

1. An elongate horizontal head and back support structure with front and rear ends and engageable on and within substantially horizontal sand and turf planes with top surfaces; said support structure includes an elongate upwardly and rearwardly inclined panel with a substantially flat forwardly and upwardly disposed head and back engaging front surface, substantially longitudially extending sides, substantially horizontal laterally extending ends and a releasable coupling part at the rear of the panel positioned substantially midway between the sides and ends thereof; an elongate substantially T-shaped strut comprising an elongate, longitudinally extending normally forwardly and upwardly inclined post with an upper forward end releasably engaged with said coupling part of the panel and a lower rear end to occur adjacent the top surface of a related sand or turf plane in rearward spaced relationship from said panel, an elongate flat transversely extending foot with an upper central portion joined with the lower rear end of the post, a horizontal transversely extending lower edge spaced below the lower rear end of the post, a flat normally rearwardly and downwardly disposed rear surface and opposite ends spaced laterally outward from the central longitudinal axis of the post, the lower portion of the foot defined by said lower edge and rear surface occurs below the lower rear end of the post to penetrate and establish anchored engagement in a sand or turf plane with which the support is related.

2. The head and back support structure set forth in claim 1 wherein the coupling part includes a receptacle with a substantially rearwardly opening post receiving socket, the axis of the socket is annularly disposed at an angle of about 15° relative to the plane of said front surface and toward one end of the panel and said panel is rotatable to selectively releasably engage the post in said socket in a first position where said one end of the panel establishes the upper rear end of the panel and a second position where said one end of the panel establishes the lower forward end of the panel.

3. The head and back support structure set forth in claim 2 wherein said front surface is inclined upwardly and rearwardly at about 35° from normal and the axis of said post is inclined forwardly and upwardly at about 20° from horizontal when the panel and post are in said first position; and where said front surface is inclined upwardly and rearwardly betweeen 20° and 30° from normal and said post is inclined forwardly and upwardly between 30° and 45° from horizontal when said panel and post are in said second position.

4. The head and back structure set forth in claim 2 wherein said front surface is inclined upwardly and rearwardly at about 35° from normal, the lower forward edge of the panel is engaged with the top surface of a related sand or turf plane and the axis of the post is inclined forwardly and upwardly at about 20° from horizontal when the panel and post are in said first position; and wherein said front surface is inclined upwardly and rearwardly at between 20° and 30° from normal, the lower forward edge of the panel is spaced above the top surface of a related sand or turf plane and said post is inclined forwardly and upwardly at between 35° and 45° from horizontal when the panel and post are in said second position.

* * * * *